US008375466B2

(12) United States Patent
Tasezen et al.

(10) Patent No.: US 8,375,466 B2
(45) Date of Patent: Feb. 19, 2013

(54) SUICIDE PREVENTION CLOTHING

(75) Inventors: Ayla Tasezen, Fremont, CA (US); Robert E. Schilling, Menlo Park, CA (US)

(73) Assignee: Servovita, Inc., Fremont, CA (US)

( * ) Notice: Subject to any disclaimer, the term of this patent is extended or adjusted under 35 U.S.C. 154(b) by 1401 days.

(21) Appl. No.: 12/034,615

(22) Filed: Feb. 20, 2008

(65) Prior Publication Data

US 2008/0230075 A1 Sep. 25, 2008

Related U.S. Application Data

(60) Provisional application No. 60/918,632, filed on Mar. 19, 2007.

(51) Int. Cl.
*A41D 13/00* (2006.01)

(52) U.S. Cl. ..... 2/69; 2/114; 2/51; 2/81

(58) Field of Classification Search ..... 2/69, 114, 2/51, 81

See application file for complete search history.

(56) References Cited

U.S. PATENT DOCUMENTS

| | | | | | |
|---|---|---|---|---|---|
| 2,851,389 | A * | 9/1958 | Lappala | 428/220 |
| 3,696,443 | A | 10/1972 | Taylor | |
| 4,570,268 | A * | 2/1986 | Freeman | 2/114 |
| 4,674,135 | A | 6/1987 | Greene | |
| 5,103,501 | A | 4/1992 | Meisels | |
| 5,359,950 | A * | 11/1994 | Schellas | 112/417 |
| 5,461,727 | A | 10/1995 | Braswell-Moore | |
| 5,660,914 | A * | 8/1997 | Essig et al. | 428/110 |
| 5,832,749 | A | 11/1998 | Antonietti | |
| 5,941,186 | A * | 8/1999 | Argentino | 112/441 |
| 6,475,201 | B2 | 11/2002 | Saito et al. | |
| 7,191,500 | B2 | 3/2007 | Bridges | |
| 2003/0088902 | A1 | 5/2003 | Levy | |
| 2003/0126668 | A1 * | 7/2003 | Scroggins | 2/114 |
| 2004/0148676 | A1 * | 8/2004 | Barker et al. | 2/69 |
| 2006/0293639 | A1 | 12/2006 | Van Gompel et al. | |
| 2007/0149937 | A1 | 6/2007 | Reiss et al. | |
| 2007/0286976 | A1 | 12/2007 | Selen et al. | |

* cited by examiner

*Primary Examiner* — Alissa Tompkins
(74) *Attorney, Agent, or Firm* — O'Melveny & Myers LLP

(57) ABSTRACT

An article of clothing that can be worn by suicidal inmates and medical patients is provided. In one embodiment, the article of clothing is comprised of a high-strength fabric consisting of an outer layer of tear-proof material, an inner layer of soft material, and a third layer of insulating material between the outer and inner layers that provides warmth and bulk to the fabric. The three layers are joined together with a nylon thread. The article of clothing is further comprised of at least one sleeve section that is removably attached to at least in part to a torso section, wherein the at least one sleeve section detaches from the torso section to prevent a user from injuring or killing himself. In another embodiment, the article of clothing is comprised of a non-woven cellular material with very low tensile strength that cannot effectively be fashioned into a rope or noose.

14 Claims, 4 Drawing Sheets

SUICIDE PREVENTION CLOTHING

RELATED APPLICATION DATA

This application claims the benefit, pursuant to 35 U.S.C. §119(e), of U.S. provisional application Ser. No. 60/918,632, filed Mar. 19, 2007.

BACKGROUND OF THE INVENTION

1. Field of the Invention

The present invention relates generally to anti-suicide articles of clothing and relates particularly to an anti-suicide article of clothing that is comfortable to wear, yet prevents a user from using the article to commit suicide.

2. Description of Related Art

In prisons and jails there is always a percentage of inmates that need to be kept isolated from other inmates (e.g., solitary confinement) for a variety of reasons such as punishment for certain types of crimes, bad behavior, contagious illness, the tendency to fight with other inmates, etc. Similarly, patients of mental health facilities may be dangerous to themselves and other patients or the facility staff and need to be kept in isolation for extended periods of time. In these scenarios, there exists the possibility that inmates and patients, respectively, may have severe anxiety, depression, or even suicidal tendencies. In such cases, these individuals may attempt to make use of their clothing (or parts thereof) to hang themselves. 2004 statistics show that in the U.S., death by hanging, strangulation, or suffocation is the second most common method (after firearms) for a person to commit suicide, with 22.4% of suicide victims having committed suicide by the former method.

In an effort to prevent a user (e.g., inmate, patient, etc.) from using his clothing to hang himself, the users are issued special protective clothing (e.g., clothing that is tear resistant). A current fabric used to manufacture protective clothing consists of a high strength nylon shell sewn together with nylon thread. A drawback of items made from this material is that they feel rough against the skin of the wearer and are thus extremely uncomfortable for the inmate or patient. When articles of clothing constructed from this material are worn for relatively long periods of time, the discomfort caused by the use of these items often increases the agitation of the at-risk individual, potentially further compromising the mental state of the inmate or patient.

One type of existing clothing available for wear by individuals with suicidal tendencies is an isolation smock or safety smock. These garments are sometimes constructed of material of a one-piece design with no sleeves. This is because sleeves can either be tied together to create a rope or used individually as a noose. To prevent tearing, the smocks often are made of a material that is tear-resistant, such as nylon or polyester. Because the smocks are manufactured for strength, not comfort against the user's skin, the wearer of such a smock will often complain to medical personnel, prison guards, or facility staff, as appropriate.

Accordingly, there is a need for an anti-suicide article of clothing that overcomes the aforementioned drawback, that is comfortable to wear, and cannot be used to commit suicide.

SUMMARY OF THE INVENTION

The present invention provides a comfortable article of clothing that can be worn by inmates and medical patients, wherein there is a danger of suicide or self-injury by such persons. In one embodiment, the article of clothing is comprised of a high-strength fabric consisting of an outer layer of tear-proof, high strength natural or synthetic material and an inner layer of soft natural or synthetic material. Between the inner and outer layers of material is sandwiched a third layer of insulating material to provide warmth and additional bulk to the fabric. The three materials are joined together with a nylon thread stitched in a pattern. In one embodiment of the present invention, the article of clothing is a smock. The smock provides strength, warmth and comfort for suicidal inmates and patients. The smock further comprises at least one sleeve section that is removably attached to a torso section, wherein at least one sleeve section breaks away or detaches from the torso section at least in part when a user pulls at least one sleeve section away from the torso section. For example, in one embodiment of the present invention, at least one sleeve section can be completely removed from the torso section when a user pulls the at least one sleeve section away from the torso section. In another embodiment of the present invention, the at least one sleeve section only partially breaks away (or detaches) from the torso section.

In another embodiment of the present invention, the article of clothing is comprised of a material that has less than a few ounces of tensile strength, thereby preventing the user from injuring or killing himself with the article of clothing. In one embodiment of the present invention, the article of clothing is an undergarment. In this embodiment, the undergarment further comprises at least one layer of synthetic or cellulose material with waist and leg openings and is disposable. The undergarment can utilize a single-strand of elastic thread around the waist and leg openings for a snug fit around the user's body. In a variation of this embodiment, the undergarment is comprised of at least one layer of the synthetic or cellulose material in an approximately rectangular shape having no openings. The undergarment is folded around the portion of the body of the user, wherein a first side and a second side of the material are fastened together by a plurality of removable fastening devices.

In another embodiment of the present invention, there is provided an article of clothing for suicide prevention, comprised of an outer layer, an inner layer, a middle layer between the inner and outer layers, and a nylon thread material for holding the outer, inner and middle layers together. The outer layer consists of a polyester material that has a weight of greater than 300 denier and is tear-resistant, thereby preventing the user from tearing the outer layer into strips and using the strips to construct a rope for committing suicide. In contrast, the inner layer consists of a cotton material that is greater than 7.2 ounces, while the middle layer consists of polyester fiberfill material that is greater than 2 ounces.

In another embodiment of the present invention, there is provided an article of clothing for suicide prevention, comprised of a torso section, at least one sleeve section, and a plurality of relatively short-length removable fastening devices connecting at least in part the at least one sleeve section to the torso section. The torso section covers at least a portion of the user, while the at least one sleeve section covers at least a portion of at least one arm of the user. A plurality of relatively short-length removable fastening devices are preferably used instead of a single relatively long removable fastening device. This is because a single relatively long removable fastening device can be used (itself) to form a rope for committing suicide.

In another embodiment of the present invention, there is provided an article of clothing for suicide prevention. The article of clothing includes a plurality of openings and consists of a non-woven material, nylon thread for stitching the non-woven material together into a shape and a single elastic thread attached to the non-woven material at each one of the plurality of openings. The non-woven material is relatively weak, thereby allowing a user to tear the non-woven material into strips and to use the strips to construct a rope, but preventing the user from using the rope to commit suicide (due to the strength (or lack thereof) of the non-woven material). The shape of the non-woven material allows the article of clothing to cover a portion of a body of the user. The single elastic thread is adapted to prevent the non-woven material from falling off of the portion of the body of the user.

In yet another embodiment of the present invention there is provided an article of clothing for suicide prevention. The article of clothing consists of a non-woven cellulose material, nylon thread for stitching the non-woven cellulose material together into a shape, and a plurality of removable attachment devices at a plurality of opposing ends of the article of clothing. The non-woven cellulose material is relatively weak, thereby allowing a user to tear the non-woven cellulose material into strips and to use the strips to construct a rope, but preventing the user from using the rope to commit suicide. The shape of the non-woven material allows the article of clothing to cover a portion of a body of the user. The plurality of removable attachment devices are adapted to affix a plurality of opposing end portions of the article of clothing around the portion of the body of the user.

A more complete understanding of the anti-suicide garment will be afforded to those of skill in the art, as well as a realization of additional advantages and objectives thereof, by a consideration of the following detailed description of a preferred embodiment. Reference will be made to the appended sheets of drawings which will first be described briefly.

DETAILED DESCRIPTION OF THE PREFERRED EMBODIMENT

The present invention provides a comfortable article of clothing that can be worn by inmates and medical patients, wherein there is a danger of suicide or self-injury by such persons. One advantage of such an article of clothing is that the wearer is kept warm and maintains some dignity by being covered with a fair amount of comfortable clothing, but is unable to destruct the clothing in such a way as to be used to construct a rope or a noose. The invention thereby overcomes the drawbacks of the prior art. The following embodiments of the invention describe elements comprised of particular materials, as well as describing particular types of fastenings that are illustrative only. These embodiments are not to be considered limiting in any respect. In the detailed description that follows, like element numerals are used to indicate like elements appearing in one or more of the figures.

Figure 1:
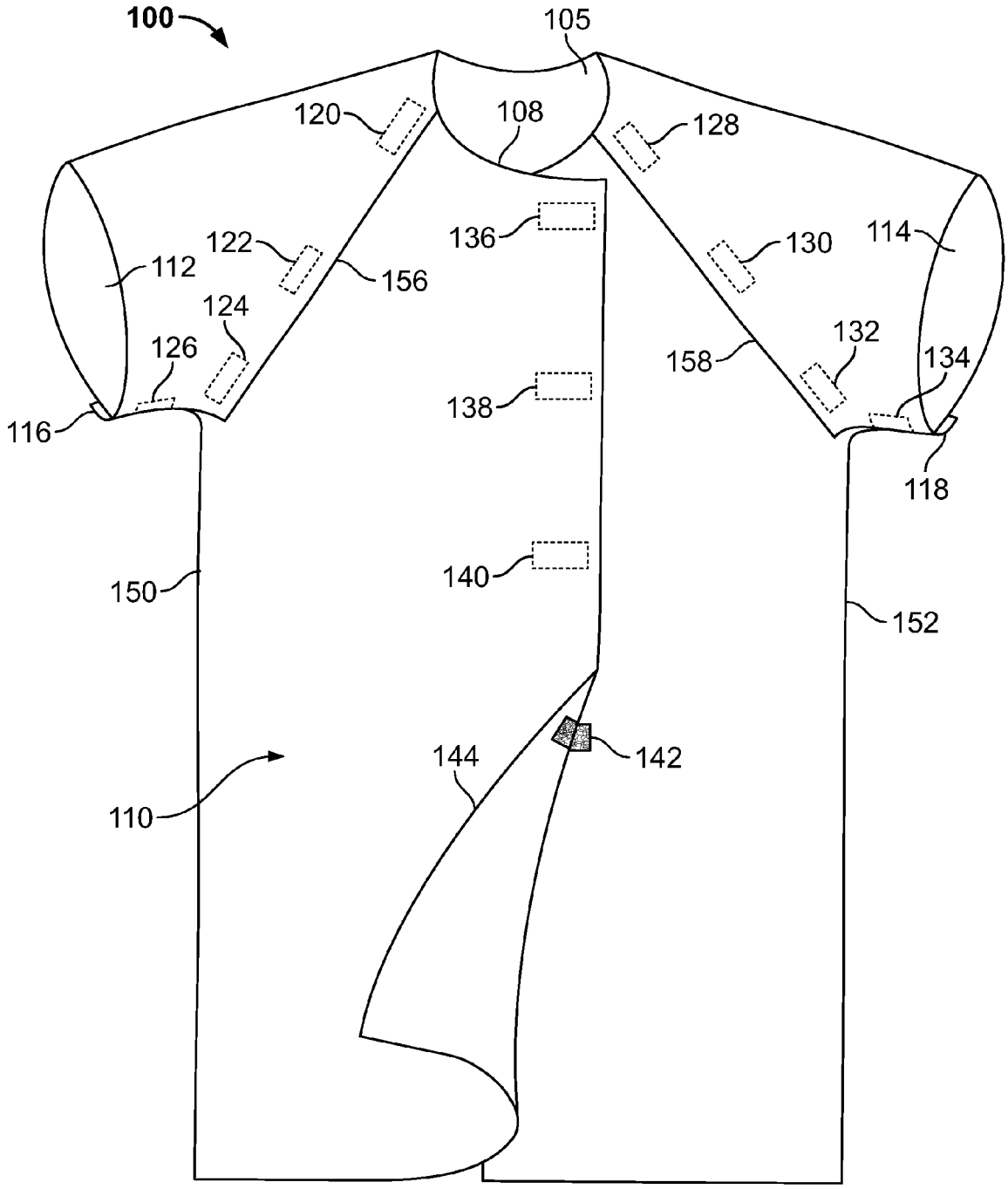
FIG. 1 is a front perspective view of an anti-suicide smock with break-away sleeves in accordance with one embodiment of the present invention, when viewed from the front.

FIG. 1 is a front perspective view of an anti-suicide smock 100 with break-away sleeves or sleeve sections 112 and 114 in accordance with one embodiment of the present invention, when viewed from the front. The smock 100 provides warmth and dignity to a user and can easily be manufactured in different sizes to fit users of differing heights and girth. The smock 100 is comprised of a torso section 110 that covers at least a portion of a torso of a user, at least one sleeve section 112 or 114, and a plurality of interlocking removable fastener devices 120-142. In a preferred embodiment, the smock 100 contains both sleeve sections 112 and 114; however, the smock 100 can be constructed with just one of sleeve sections 112 and 114, for situations such as a one-armed user or where the user currently has one arm in a splint or cast. The smock 100 is further comprised of a left portion 150, a right portion 152, a neck opening 105, a torso flap 144, sleeve flaps 116 and 118, as well as sleeve flaps 156 and 158.

The removable fastener devices 120-142 each are comprised of at least two of a plurality of interlocking components that are placed on opposing sides of the portion of the smock 100. In a variation of this embodiment, the removable fastener devices 120-142 are each comprised of a single interlocking component that is adapted to be placed on a single side of the smock 100, wherein the interlocking component directly adheres or mates with the surface of the material that comprises the smock 100.

The removable fastener devices 120-142 serve several purposes. First, the removable fastener devices 136-142 that are placed along the torso flap 144 connect the left portion 150 to the right portion 152. Second, the removable fastener devices 120-124 connect the sleeve flap 156 to the left portion 150 and similarly, the removable fastener devices 128-132 connect the sleeve flap 158 to the right portion 152. The removable fastener device 126 connects the sleeve flap 116 attached to a front portion of the sleeve section 112 to a back portion of the sleeve section 112. Similarly, the removable fastener device 134 connects the sleeve flap 118 attached to a front portion of the sleeve section 114 to a back portion of the sleeve section 114. A key use of the plurality of interlocking removable fastening devices 120-142 versus having a single removable fastening device along the entire length of each removably attached portion of the smock 100 is to prevent the user from separating such a relatively long removable fastening device from the smock 100 and fashioning the removable fastening device into a rope or a noose to hang himself. For example, if removable fastening devices 128, 130, and 132 were combined into one long fastening device (not shown) to effectively join the entire first portion of the sleeve flap 158 to the right portion 152, the user could possibly tear away the one long fastening device from the first portion of the sleeve flap 158 and use the device to construct a rope or a noose.

Another key use of devices 120-134, however, is to provide break-away sleeve functionality to prevent the user from forcing his head into the sleeve section 112 or 114 in an attempt to hang himself. Other anti-suicide smocks in existence specifically do not have sleeves (let alone break-away sleeves) to prevent the user from attempting to injure himself in this manner. More specifically, if existing anti-suicide smocks had large diameter rigidly attached sleeves, the user could attempt to hang himself with such a smock by tying a portion of such a smock to a relatively fixed or heavy article of furniture or a sturdy fixture in the user's cell or room, putting his head in one of the sleeve openings, and using his own body weight to hang himself. The break-away sleeve sections 112 and 114 of the present invention prevent the user from hanging himself in such a manner. That is, the sleeve sections 112 and 114 can partially break-away from the left portion 150 and the right portion 152, respectively.

In particular, the sleeve flaps 156 and 158 will open and unroll away from the torso section 110 when a user attempts to injure himself in by pushing his head into the proximal ends of the sleeve sections 112 or 114 via the interior side of the torso section 110, causing removable fastener devices 120-124 and 128-132, respectively, to release a first portion of the sleeve flaps 156 and 158. In a variation of this embodiment, the sleeve sections 112 and 114 can have relatively large diameters that allow the user to easily place his head inside the interior of the sleeve sections 112 or 114. If the user ties off a portion of the smock 100 to a relatively fixed article of furniture or a fixture in his cell or room and then attempts to apply his own body weight against the smock 100 in an effort to hang himself, the removable fastener devices 120-124 and 128-132, respectively, will release the first portion of the sleeve flaps 156 and 158.

Similarly, if the user attempts to push his head into either of the open ends of the sleeve sections 112 or 114 that are distal from the torso section 110, removable fastener devices 126 and 134, respectively, will release a second portion of the sleeve flaps 156 and 158. As the user proceeds to push his head deeper into the opening in the sleeve sections 112 or 114, additional removable fastener devices 120-124 and 128-132, respectively, will release the first portions of the sleeve flaps 156 and 158. The sleeve sections 112 and 114 are illustrated as being relatively short, like a short-sleeve t-shirt, to prevent the user from tying the sleeves 112 and 114 together to form a rope that can be used to injure or kill the user. One of skill in the art will appreciate that the sleeve sections 112 and 114 can also comprise longer length sleeves. In a variation of this embodiment, there are additional removable fastening devices (not shown) attached to the rear portion of the sleeve sections 112 and 114 so that the entire sleeve sections 112 and 114 can be completely removed from the torso section 110 when the user pushes his head into the opening of the sleeve sections 112 or 114.

In a preferred embodiment, the removable fastener devices 120-142 are comprised of hook-and-loop fasteners (e.g., Velcro™ fasteners, licensed or manufactured by Velcro Industries B.V. Ltd. Liability Co., Netherlands). Hook-and-loop-type fastener systems are comprised of a pair of complementary surfaces, generally available in strip or pad form. One of the strips or pads is provided with a hooked surface, and the mated strip or pad is provided with a looped surface. Once the complementary strips or pads are placed in mated juxtaposition and a light pressure is applied, they form a mechanical bond and provide a strong, semi-permanent closure which may be opened by removing, in sequence, a small portion of the hook and loop bond, preserving the system for reuse. One of skill in the art will appreciate that other types of removable fastener devices 120-142 such as the use of snap fasteners that are comprised of a pair of interlocking discs or the use of buttons and opposing buttonholes or reinforced slits that utilize thin breakable thread are also within the spirit and scope of the present invention.

Figure 2:
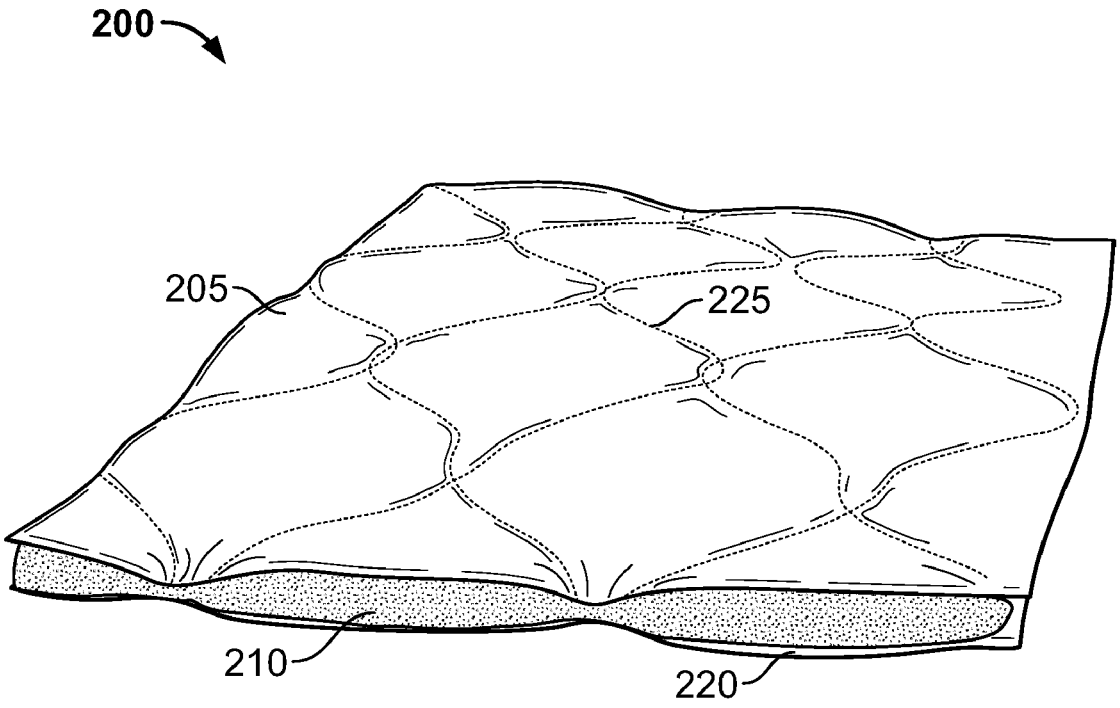
FIG. 2 is a side perspective view of a multi-layered swatch of fabric used to construct the smock illustrated in FIG. 1 in accordance with one embodiment of the present invention.

FIG. 2 is a side perspective view of a multi-layered swatch of fabric 200 used to construct the smock 100 in accordance with one embodiment of the present invention. The fabric 200 is similar to a quilt. The fabric 200 is comprised of an outer layer 205, a middle layer 210, an inner layer 220, and thread 225 that holds together the outer layer 205, the middle layer 210, and the inner layer 220. The outer layer 205 is comprised of highly tear-resistant woven materials like polyester or nylon.

The outer layer 205 can also be comprised of other materials such as those commonly used to construct parachutes and can include a low-stretch Dacron™ or zero-stretch Spectra™, Kevlar™, Vectran™, as well as high-modulus aramids. The tear-resistant property of the outer layer 205 prevents the user from tearing the outer layer 205 into strips and using the strips to construct a rope for committing suicide. In a preferred embodiment, the outer layer 205 is comprised of a polyester material that is greater than 300 denier in weight; preferably 600 denier, though one of skill in the art will recognize that different weights and types of materials can be utilized within the spirit and scope of the present invention. Due to the need for the outer layer 205 to be comprised of a strong tear-resistant material, the outer layer 205 is generally sensed as being hard and uncomfortable against the skin by the user, possibly causing chafing and rashes if the inner layer 220 were composed of the same material.

The inner layer 220 is comprised of a soft material that is comfortable against the skin. In a preferred embodiment, the inner layer 220 is comprised of cotton material that in turn can contain 100% cotton material or a cotton blend material. In order to provide adequate strength and softness against the skin of the user, the cotton material 1 is of a weight of greater than 7.2 ounces and in a preferred embodiment weighs 8.5 ounces. One of skill in the art will recognize that the inner layer 220 can also be comprised of other weights and types of natural and synthetic materials and still remain within the spirit and scope of the present invention.

The middle layer 210 serves as batting or an insulating material that adds bulk to the fabric 200 and allows the smock 100 to provide warmth to the user. To adequately accomplish this function, in a preferred embodiment, the middle layer 210 is comprised of polyester fiberfill of a weight greater than 2 ounces, though other weights and types of natural or synthetic fill materials can also be effectively utilized within the spirit and scope of the present invention. In a preferred embodiment, the middle layer is comprised of 4 ounce polyester fiberfill.

The inner layer 220, the middle layer 210, and the outer layer 205 are fastened together by the thread 225. The thread 225 is sewn into a pattern that for ease of manufacturing repeats and can form a multitude of particular shapes and patterns. Perhaps one of the easier to manufacture patterns is the diamond-like pattern illustrated in FIG. 2, though of course other such patterns as squares or rectangles can be utilized as well. Further, the size of each recurring pattern section (e.g., the dimensions of each diamond) can vary. To provide durability and washability by commercial laundering methods, as well as to prevent the user from being able to tear apart the fabric 200, a fairly heavy nylon thread of greater than 33 denier is utilized, and in a preferred embodiment, 69 denier nylon thread is utilized, though one of skill in the art will recognize that other weights and thread materials can also be effectively utilized within the spirit and scope of the present invention.

Figure 3:
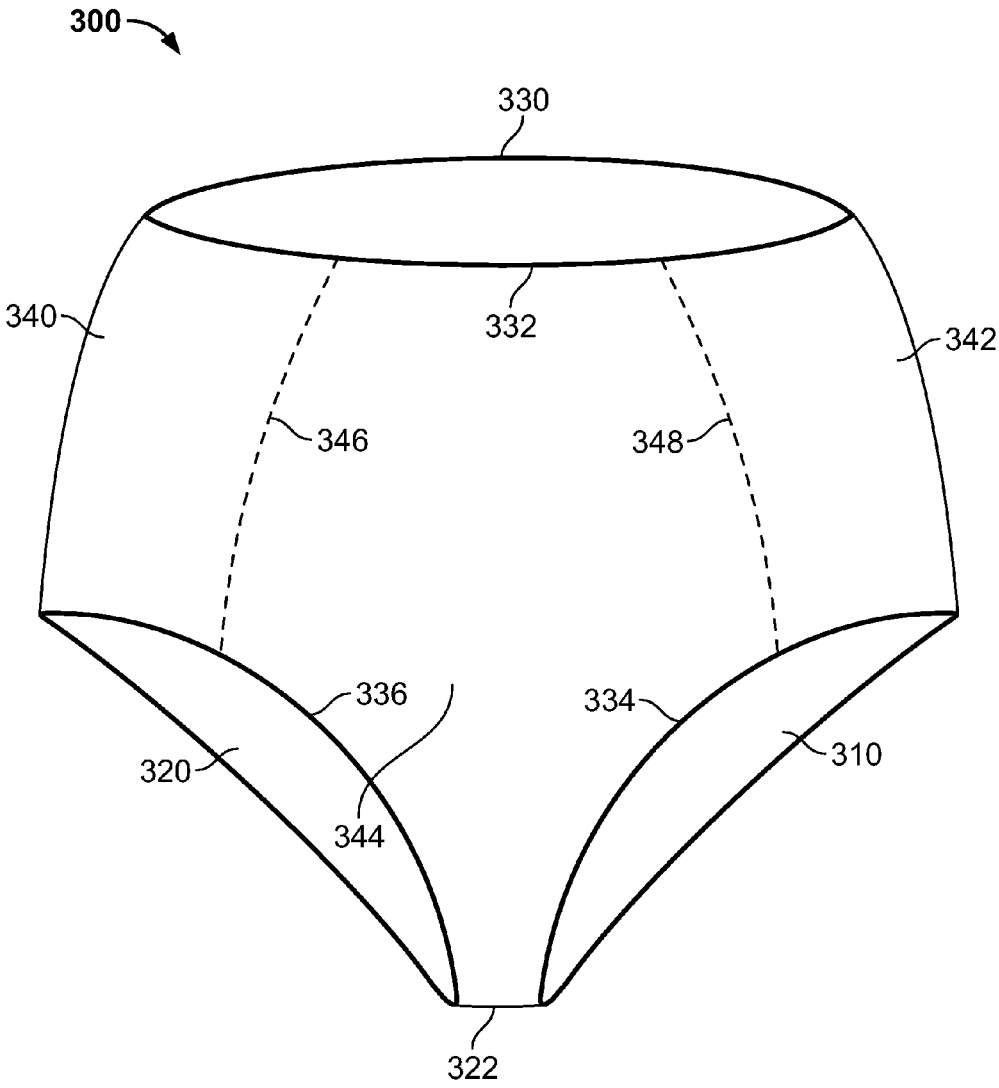
FIG. 3 is a front perspective view of an article of clothing for suicide prevention in the form of an undergarment in accordance with one embodiment of the present invention.

FIG. 3 is a front perspective view of an article of clothing for suicide prevention in the form of an undergarment 300 in accordance with one embodiment of the present invention. The undergarment 300 is comprised of a crotch portion 344, a left portion 340, a right portion 342, and a plurality of opening that comprise torso opening 330 and leg opening 320 and 310.

While conventional undergarments are comprised of natural or synthetic material such as cotton and can be laundered and re-used, the undergarment 300 is comprised of a thin, easily tearable, non-woven synthetic or natural material such as cellulose or, in a preferred embodiment, natural vegetable fiber that is comfortable for the user to wear and enables the undergarment 300 to be flushed down a municipal toilet for disposal after use. The body of the undergarment 300 can be made of a single layer of material or may be comprised of a plurality of layers in strategic areas such as the crotch portion 344 to prevent leakage. One of the physical properties of the undergarment 300 that is comprised of a single layer of non-woven cellulose material is that the material is relatively weak, thereby allowing the user to tear the undergarment 300 into strips and to use the strips to construct a rope or noose, but preventing the user from using the rope to commit suicide, since such a rope will tear when tensile stress is applied by the user.

Thread (not shown) is utilized for stitching to form the material into the shape of the undergarment 300 that can cover a portion of the body of the user, though the undergarment 300 can have different shapes to accommodate users of differing size and weight. In a preferred embodiment, the thread is comprised of nylon thread. Stitched areas 346 and 348 located on the left portion 340 and the right portion 342, respectively, connect a second layer of material that is attached to the undergarment 300 to form the crotch portion 344 that helps prevent leakage. Unlike conventional undergarments, there is no fly area that opens to allow the user to urinate without removing the undergarment 300 from the user's torso. This is to prevent the user from being able to tear away the material that would form a fly area and fashioning a rope. In another embodiment (not shown), there is no second layer of material connected to the left portion 340 and the right portion 342, and thus no stitching 346 and 348 utilized in the undergarment 300.

The edges of the undergarment 300 surrounding the plurality of openings 330, 320, and 310 are comprised of a single elastic thread attached to the non-woven material at each of openings 330, 320, and 310. The single elastic thread at openings 330, 320, and 310 is fashioned into elastic edges 332, 336, and 334, respectively. Elastic edges 332, 336, and 334 prevent the non-woven material from falling off the appropriate portions of the body in contact with the undergarment 300 (i.e., the waist area and the tops of the user's legs). The elastic edges 336 and 334 also form a loose seal against the user's upper legs that help to prevent any leakage that might otherwise occur from an accidental urination or bowel movement for a short period of time. Unlike conventional undergarments, the elastic edges 332, 336, and 334 are very thin and small and the undergarment 300 does not have a waistband in the conventional sense. This serves to prevent the user from tearing the elastic edges 336, 334, and 332 away from the undergarment 300 and fashioning them into a rope with sufficient tensile strength for the user to form a noose or asphyxiate himself using the single elastic thread that comprises the elastic edges 336, 334, and 332. One of skill in the art will recognize that the elastic edges 336, 334, and 332 can be comprised of a variety of types of elastomeric material other than natural or synthetic rubber. In a variation of the embodiment (not shown), the undergarment 300 has pleats or folds of the cellulose material that attaches to the elastic edges 336, 334, and 332 to help form the thin weak single layer of material into the shape of the undergarment 300.

Figure 4:
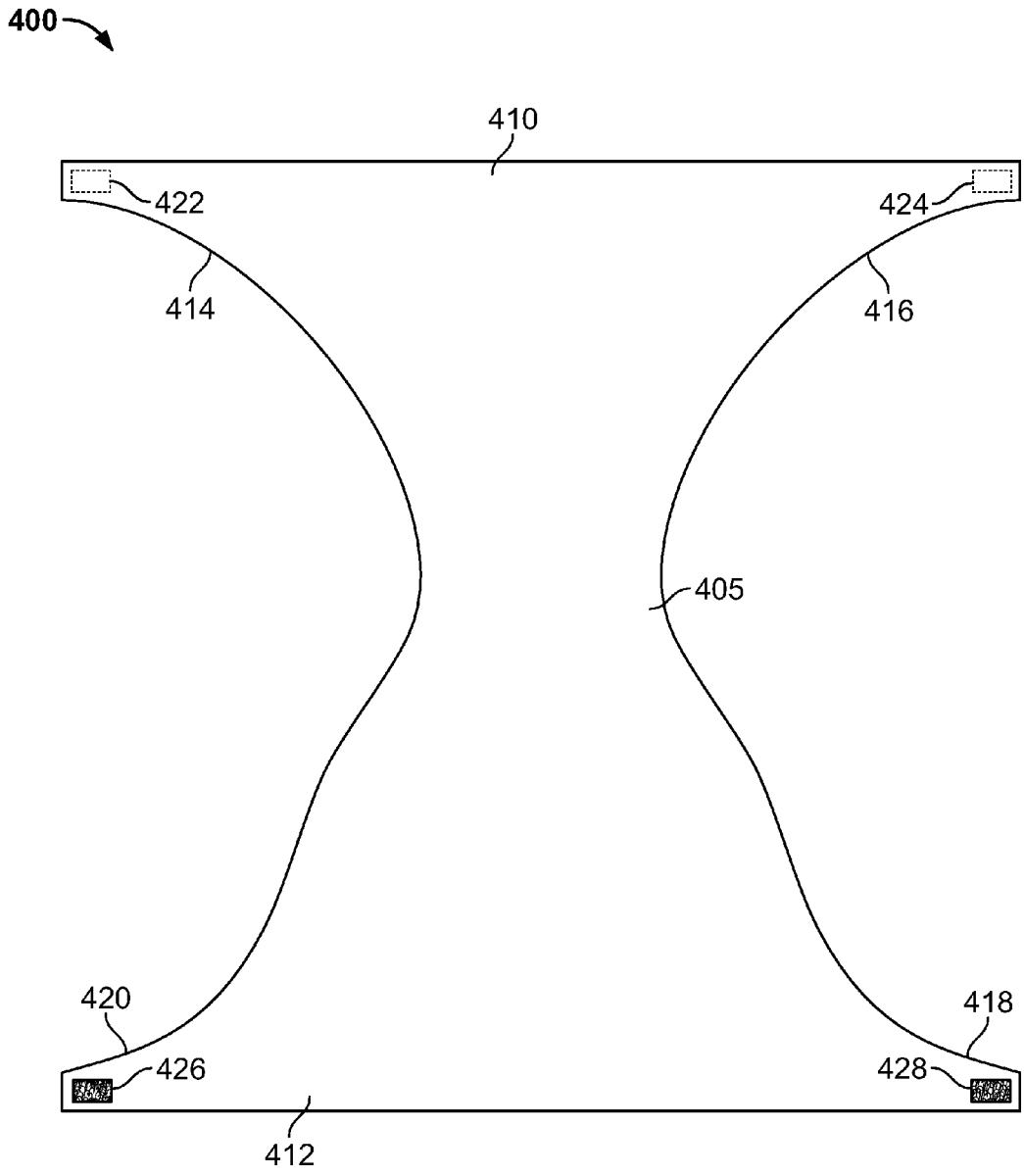
FIG. 4 is top perspective view of an article of clothing for suicide prevention in the form of an adult diaper in the open position in accordance with one embodiment of the present invention.

FIG. 4 is top perspective view of an article of clothing for suicide prevention in the form of an adult diaper 400 in the open position in accordance with one embodiment of the present invention. The diaper 400 is comprised of a body 405, a front section 410, and a rear section 412. Conventional diapers are primarily worn for incontinence reasons and/or uncontrollable bowels and are comprised of thick absorbent materials. The purpose of a conventional diaper is to absorb moisture and contain mess so that the user can remain dry and comfortable after wetting or soiling himself through a bowel movement or urination. Conventional diapers include cloth diapers that are comprised of layers of fabric such as terry toweling and can be washed and reused multiple times, as well as disposable diapers that contain absorbent chemicals and can be thrown away after use. Often, to avoid leakage of liquid or solid waste, plastic pants or other forms of diaper covers are worn externally over the conventional diaper by the user. In contrast, the diaper 400 is intended to be worn by a user that is capable of utilizing a toilet or restroom and does not require the bulk, level of absorbency and anti-leakage properties of the conventional diaper or plastic pants.

The body 405 is comprised of a thin, easily tearable, non-woven synthetic or natural material such as cellulose, or in a preferred embodiment, natural vegetable fiber that is comfortable for the user to wear and enables the diaper 400 to be flushed down a municipal toilet for disposal after use. The body 405 can be made of a single layer of material or may be comprised of a plurality of layers in strategic areas such as the crotch area to prevent leakage. One of the physical properties of the diaper 400 that is comprised of a single layer of non-woven cellulose material is that the material being relatively weak, allows the user to tear the diaper 400 into strips and to use the strips to construct a rope or noose, but prevents the user from using the rope to commit suicide, since such a rope will tear when tensile stress is applied by the user.

Thread (not shown) may be utilized for stitching to form the material into the shape of the body 405 that can cover a portion of the body of the user, though the body 405 can from different shapes to accommodate users of differing size and weight. In a preferred embodiment, the thread is comprised of nylon thread. In order to enable the diaper 400 to be worn around the portion of the body of the user, the diaper 400 contains a plurality of interlocking removable attachment devices affixed to front corners 414 and 416 with opposing interlocking components affixed to rear corners 420 and 418, respectively. The removable fastener devices 422-428 each are comprised of at least two of a plurality of interlocking components that are placed on opposing sides of the front corner 414 and the rear corner 420 and the front corner 416 and the rear corner 418, respectively. The removable fastening devices can be comprised of hook-and-loop fasteners (e.g., Velcro™), snaps, tape, stiff foldable tabs, or the like.

Having thus described a preferred embodiment of anti-suicide articles of clothing, it should be apparent to those skilled in the art that certain advantages of the invention have been achieved. For example, the anti-suicide smock with break-away sleeves that prevent the user from forcing his head into one of the plurality of sleeve sections to suffocate himself has been illustrated, but it should also be appreciated that various modifications, adaptations, and alternative embodiments thereof may be made within the scope and spirit of the present invention. The invention is further defined by the following claims.

What is claimed is:

1. An article of clothing for suicide prevention, comprising:

an outer layer consisting of a polyester material that is greater than 300 denier, said outer layer being tear-resistant, an inner layer consisting of a cotton material that is greater than 7.2 ounces;

a middle layer between said outer and inner layers, said middle layer consisting of a polyester fiberfill material that is greater than 2 ounces; and a nylon thread material for holding said outer, inner and middle layers together, whereby a user is prevented from tearing said outer layer into strips and using said strips to construct a rope for committing suicide; and said article of clothing is a smock comprising:

a torso section for covering at least a portion of a torso of said user;

at least one sleeve section for covering at least a portion of at least one arm of said user; and a plurality of interlocking removable fastening devices for connecting, at least in part, said at least one sleeve section to said torso section.

2. The article of clothing of claim 1, wherein said nylon thread material is greater than 33 denier.

3. The article of clothing of claim 1, wherein said plurality of interlocking removable fastening devices comprise hook-and-loop fasteners.

4. The article of clothing of claim 1, wherein said plurality of interlocking removable fastening devices are further for connecting a left portion of said torso section to a right portion of said torso section on a front side of said user.

5. The article of clothing of claim 1, wherein said plurality of interlocking removable fastening devices are further for connecting a front portion of said at least one sleeve section to a back portion of said at least one sleeve section.

6. The article of clothing of claim 1, wherein said polyester material consists of 600 denier polyester.

7. The article of clothing of claim 1, wherein said cotton material consists of 8.5 ounce cotton.

8. The article of clothing of claim 1, wherein said polyester fiberfill material consists of 4 ounce polyester fiberfill.

9. The article of clothing of claim 1, wherein said nylon thread material consists of 69 denier nylon thread.

10. An article of clothing for suicide prevention, comprising:

a torso section for covering at least a portion of a torso of a user;

at least one sleeve section for covering at least a portion of at least one arm of said user; and a plurality of interlocking removable fastening devices for connecting, at least in part, said at least one sleeve section to said torso section, whereby said plurality of interlocking fastening devices are adapted to prevent said user from using said torso section and said at least one sleeve section as a rope and a noose, respectively, for committing suicide;

wherein said torso and said at least one sleeve sections comprise:

an outer layer consisting of a polyester material;

an inner layer that consists of a cotton material that is greater than 7.2 ounces;

a middle layer between said outer and inner layers, said middle layer consisting of a polyester fiberfill material; and a thread material for holding said outer, inner and middle layers together.

11. The article of clothing of claim 10, wherein said polyester material is greater than 300 denier.

12. The article of clothing of claim 10, wherein said plurality of interlocking removable fastening devices are further for connecting a left portion of said torso section to a right portion of said torso section.

13. The article of clothing of claim 10, wherein said plurality of interlocking removable fastening devices are further for connecting a front portion of said at least one sleeve section to a back portion of said at least one sleeve section.

14. An article of clothing for suicide prevention, comprising:

a torso section for covering at least a portion of a torso of a user;

at least one sleeve section for covering at least a portion of at least one arm of said user; and a plurality of interlocking removable fastening devices for connecting, at least in part, said at least one sleeve section to said torso section, whereby said plurality of interlocking fastening devices are adapted to prevent said user from using said torso section and said at least one sleeve section as a rope and a noose, respectively, for committing suicide;

wherein said torso and said at least one sleeve sections comprise:

an outer layer consisting of a polyester material;

an inner layer comprising at least a cotton material;

a middle layer between said outer and inner layers, said middle layer consisting of a polyester fiberfill material; and a thread material that consists of a nylon thread material that is greater than 33 denier and is for holding said outer, inner and middle layers together.

* * * * *